United States Patent [19]

Minter

[11] Patent Number: 4,801,928

[45] Date of Patent: Jan. 31, 1989

[54] EGRESS DIRECTION INDICATION SYSTEM

[75] Inventor: Ronald H. Minter, Guilford, Conn.

[73] Assignee: Chloride Group PLC, London, England

[21] Appl. No.: 902,662

[22] Filed: Sep. 2, 1986

[51] Int. Cl.[4] ..... G08B 5/36

[52] U.S. Cl. ..... 340/691; 340/332; 340/369.4; 362/147

[58] Field of Search ..... 340/691, 309.4, 332; 362/147, 153, 276, 277, 802, 364, 368, 370, 458, 84; 40/585, 570, 542

[56] References Cited

U.S. PATENT DOCUMENTS

| | | | |
|---|---|---|---|
| 2,106,968 | 2/1938 | Dannheiser | 171/97 |
| 3,153,745 | 10/1964 | Gurian et al. | 362/103 |
| 3,486,068 | 12/1969 | Dunn et al. | 315/87 |
| 3,573,541 | 4/1969 | Dunn et al. | 315/87 |
| 3,916,404 | 10/1975 | Gouge | 340/332 |
| 3,969,720 | 7/1976 | Nishino | 340/332 |
| 4,029,994 | 6/1977 | Iwans | 315/323 |
| 4,148,023 | 4/1979 | Elkin | 340/628 |
| 4,173,035 | 10/1979 | Hoyt | 362/812 |
| 4,283,657 | 8/1981 | Gordon et al. | 315/86 |
| 4,319,228 | 3/1982 | Daniels | 340/693 |
| 4,385,586 | 5/1983 | Schriever | 116/205 |
| 4,401,050 | 8/1983 | Britt et al. | 116/205 |
| 4,422,069 | 12/1983 | Edström et al. | 340/691 |
| 4,489,308 | 12/1984 | Logan, Jr. et al. | 340/286 R |

OTHER PUBLICATIONS

William F. Budnovitch, Levine Lighting, "An Emergency Illumination System for Halls", NFPA 101-TCR/ 1936T/Mar. 19, 1986, pp. 54–57, 104–108.

*Primary Examiner*—Glen R. Swann, III

*Attorney, Agent, or Firm*—Finnegan, Henderson, Farabow, Garrett & Dunner

[57] ABSTRACT

An egress detection system includes an indicator unit having at least three electroluminescent lamps in a linear arrangement and circuitry for sequentially illuminating the electroluminescent lamps on a repeated basis in order from one end of the linear arrangement to the other end of the linear arrangement. The indicator unit includes a plastic extruded panel containing a circuit board on which the electroluminescent lamps are mounted, and a lens covering the electroluminescent lamps and bonded to the panel. The panel includes an electrical connector which allows the panel to be removed from the electronic circuitry and replaced. The electronic circuitry is also provided to sequentially illuminate a group of electroluminescent lamps in one direction in response to a first sensed condition of relative danger and in another direction in response to a second sensed condition of relative danger.

24 Claims, 4 Drawing Sheets

EGRESS DIRECTION INDICATION SYSTEM

BACKGROUND OF THE INVENTION

1. Field of the Invention

The present invention relates to egress direction indication systems.

2. Description of the Related Art

Many deaths and injuries occur when people are attempting to egress from a burning building while trying to find an appropriate point of egress. Although many egress direction indication systems have been developed, deaths and injuries continue to occur because such known systems have a variety of drawbacks.

Known systems are expensive and difficult to produce, install and maintain. Direction indication lamps which are used in conventional systems consume excessive power from battery operated emergency power supply systems and therefore fail to effectively produce sufficient light after an initial period of operation. In addition, conventional indicator lamps are unreliable because they can unpredictably burn out at the time of emergency use. In addition, the indication lamps and arrangements in conventional systems are difficult to see and understand during emergency situations. Conventional systems also fail to provide information about alternative routes of egress.

It is an object of the present invention to provide an egress direction system which is inexpensive and easy to produce, install and maintain.

It is also an object of the present invention to provide direction indication lamps which do not consume excessive power and which will therefore effectively produce sufficient light after an initial period of operation.

It is a further object of the present invention to provide indicator lamps which are reliable and which do not unpredictably burn out at the time of an emergency.

It is an additional object of the present invention to produce a system having indicator lamps and arrangements which are easily seen and understood during emergency situations.

It is still a further object of the present invention to provide a system which provides information about alternative routes of egress.

SUMMARY OF THE INVENTION

To achieve the foregoing objects, and in accordance with the purposes of the invention as embodied and broadly described herein, there is provided an egress direction indication system comprising an indicator unit including at least three electroluminescent lamps in a linear arangement; and means for sequentially illuminating said at least three electroluminescent lamps on a repeated basis in order from one end of the linear arrangement to the other end of the linear arrangement.

It is preferable that the system icludes a plurality of such indicator units mounted on a wall and spaced from adjacent indicator units; a first indicator unit positioned near a point of egress and oriented so that the linear arrangement of its lamps are sequentially illuminated in the direction of the point of egress; and at least one other indicator unit so that the linear arrangement of its lamps are sequentially illuminated in the direction of the first indicator unit.

It is further preferable that the illuminating means include means for sequentially illuminating at least three electroluminescent lamps on a repeated basis in order from a first end of the linear arrangement to a second end of the linear arrangement in response to a first sensed condition of relative danger at the first end, and for sequentially illuminating at least three electroluminescent lamps on a repeated basis in order from the second end to the first end in response to a second sensed condition of relative danger at the second end thereby directing egress away from the area of relative danger.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENTS

Reference will now be made in detail to the present preferred embodiment of the invention as illustrated in the accompanying drawings.

In accordance with the present invention there is provided an egress direction indication system comprising an indicator unit including at least three electroluminescent lamps in a linear arrangement; and means for sequentially illuminating said at least three electroluminescent lamps on a repeated basis, in order, from one end of the linear arrangement to the other end of the linear arrangement.

It is preferable that the electroluminescent lamps are six in number, are shaped as arrows, and point from one end of the linear arrangement to the other end of the linear arrangement.

Figure 1:
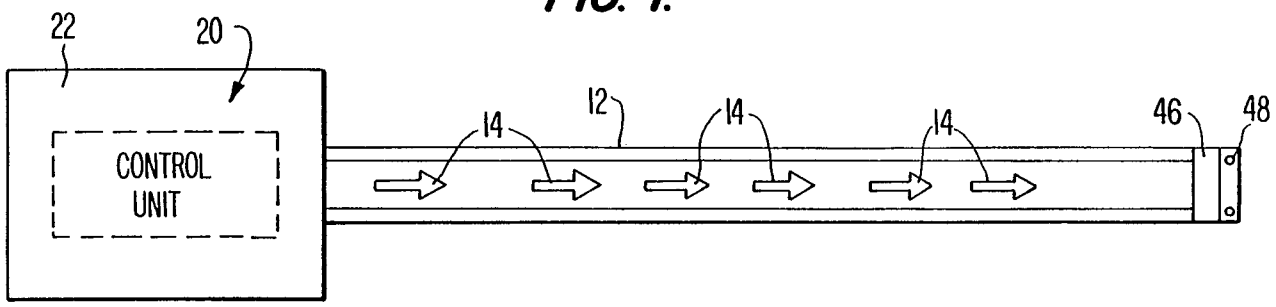
FIG. 1 is an elevation view of an egress direction indication system incorporating the teachings of the present invention.

As shown in FIG. 1, an egress direction indication system 10 includes an indicator unit 12. Electroluminescent lamps 14 are positioned in a linear arrangement along indicator unit 12 and are shaped as arrows which point from the left ends of the linear arrangement to the right end. There are preferably six electroluminescent lamps 14 in indicator unit 12. Electroluminescent lamps have been found to provide uniform light which is easier to see in smoke-filled conditions, has low power requirements and reliable long life.

Figure 8:
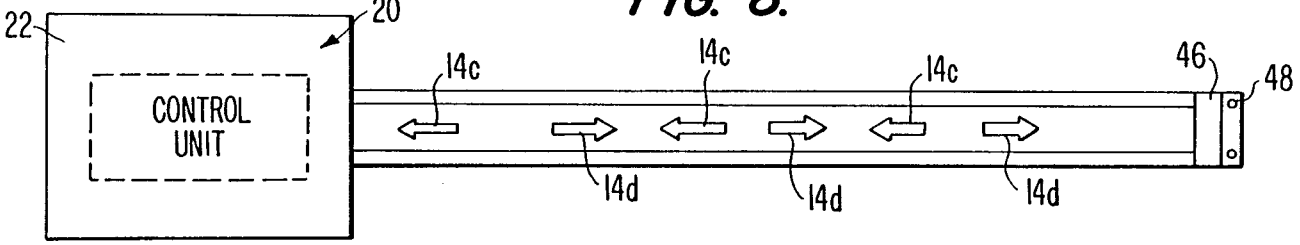
FIG. 8 is an elevation view of a third embodiment of an egress direction indication system incorporating the teachings of the present invention.

As shown in FIG. 1, all six arrow-shaped electroluminescent lamps point to the right end of the linear arrangement of luminescent lamps 14. In another embodiment, shown in FIG. 2, there are two groups of electroluminescent lamps 14. The left group of three electroluminescent lamps 14*a* point to the left end of the linear arrangement, while the right group of three electroluminescent lamps 14*b* point to the right end of the linear arrangement. In the arrangement shown in FIG. 2, the leftward pointing electroluminescent arrows 14*a* constitute a first subsystem of indicator unit 12, and rightward pointing electroluminescent arrows 14*b* constitute a second subsystem of indicator unit 12. In a further embodiment, shown in FIG. 8, the electroluminescent lamps alternate in pointing in opposite directions. The leftward pointing electroluminescent arrows 14*c* constitute a first subsystem of indicator unit 12, and rightward pointing electroluminescent arrows 14*d* constitute a second subsystem of indicator unit 12.

In accordance with the present invention, the indicator unit includes a plastic extruded panel with the electroluminescent lamps contained within the plastic extrusion. The plastic extruded panel contains a circuit board on which the electroluminescent lamps are mounted and a lens covering the electroluminescent lamps and bonded to the panel. The circuit board on which the lamps are mounted is covered by a phosphorescent/fluorescent material for emitting light which provides illumination after loss of normal lighting during power failure.

Figure 3:
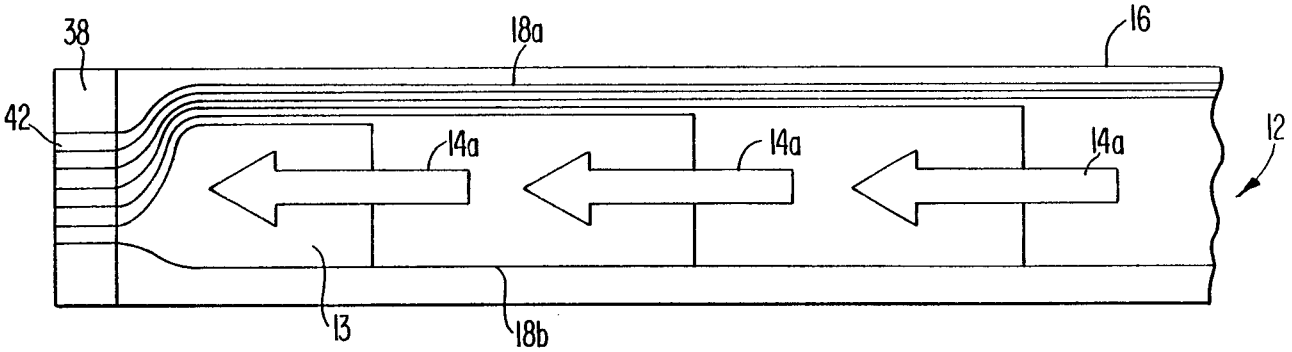
FIG. 3 is a detailed view in elevation of a portion of the arrangement shown in FIG. 2.
Figure 4:
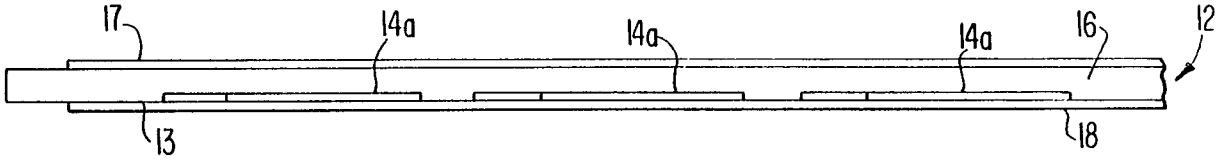
FIG. 4 is a top view of the arrangement illustrated in FIG. 3.

As shown in FIGS. 3 and 4, indicator unit 12 includes a planar plastic panel 16 with one side forming the rear surface portion of indicator unit 12. Panel 16 is extruded plastic in which electroluminescent lamps 14*a* are mounted and contained. The front surface of indicator 12 includes a lens 18 which is a planar plastic piece capable of passing light from electroluminescent lamps 14*a* and protecting electroluminescent lamps 14*a*. Lens 18 is bonded to panel 16 to constitute a single unit. A phosphorescent/fluorescent material 13 is provided on panel 16 to emit light during power failure.

As shown in FIG. 3, panel 16 includes a circuit board having printed circuit conductive leads 18*a* which run along the length of panel 16 such that each conductor 18*a* is conducted to a separate electroluminescent lamp 14. Printed conductor 18*b* runs along the length of panel 16 and constitutes the ground wire connected to complete the circuit to each electroluminescent lamp 14.

According to the present invention, the egress direction indication system includes means for sequentially illuminating said at least three electroluminescent lamps on a repeated basis in order from end of the linear arrangement to the other end of the linear arrangement.

Figure 2:
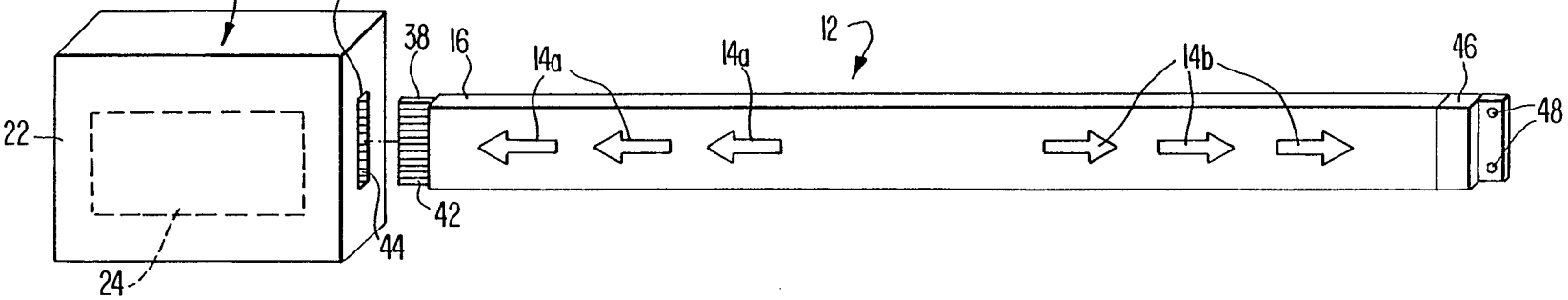
FIG. 2 is an exploded perspective view of a second embodiment of an egress direction indication system incorporating the teachings of the present invention.
Figure 6:
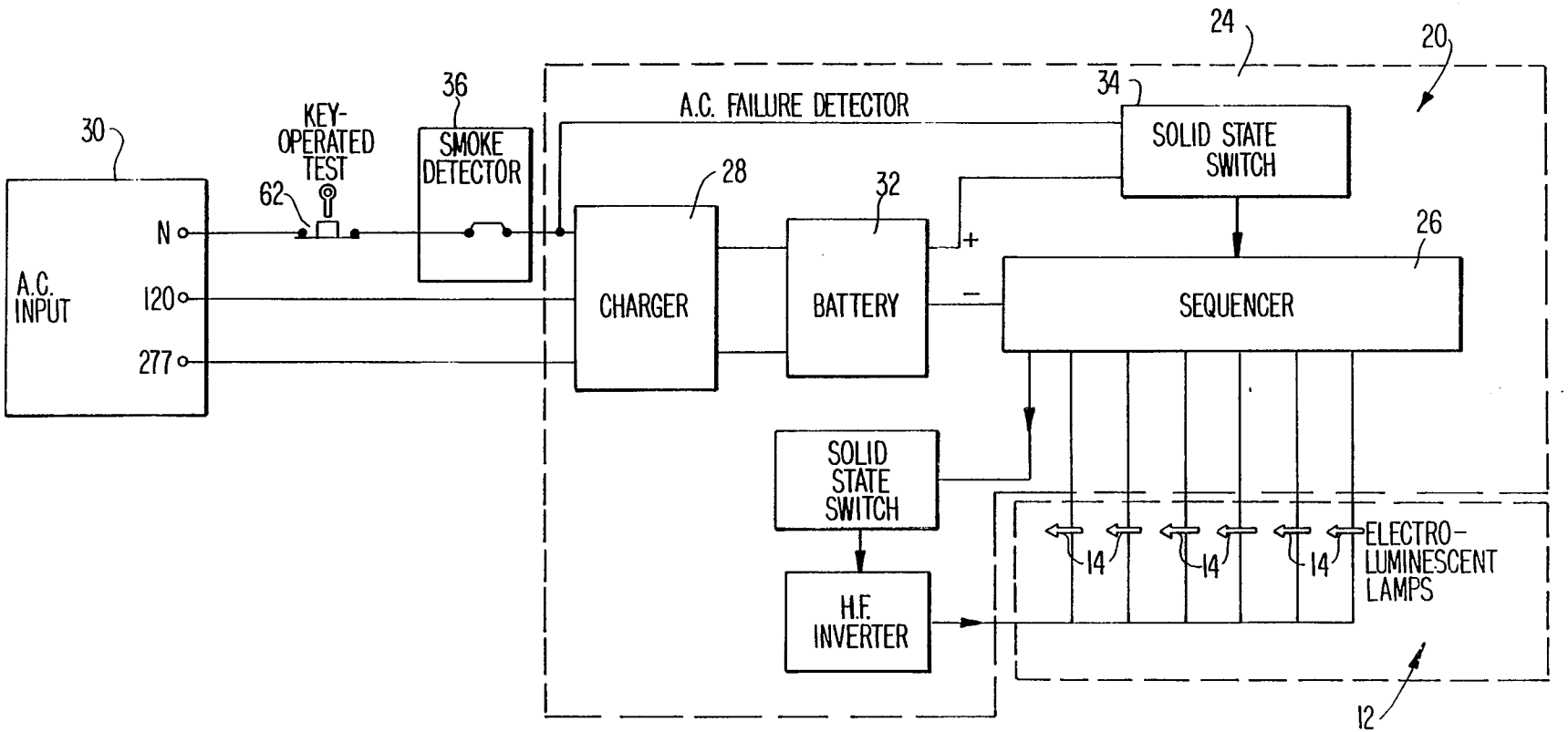
FIG. 6 is a block diagram of the electronic system for illuminating lamps in the indication system.
Figure 7:
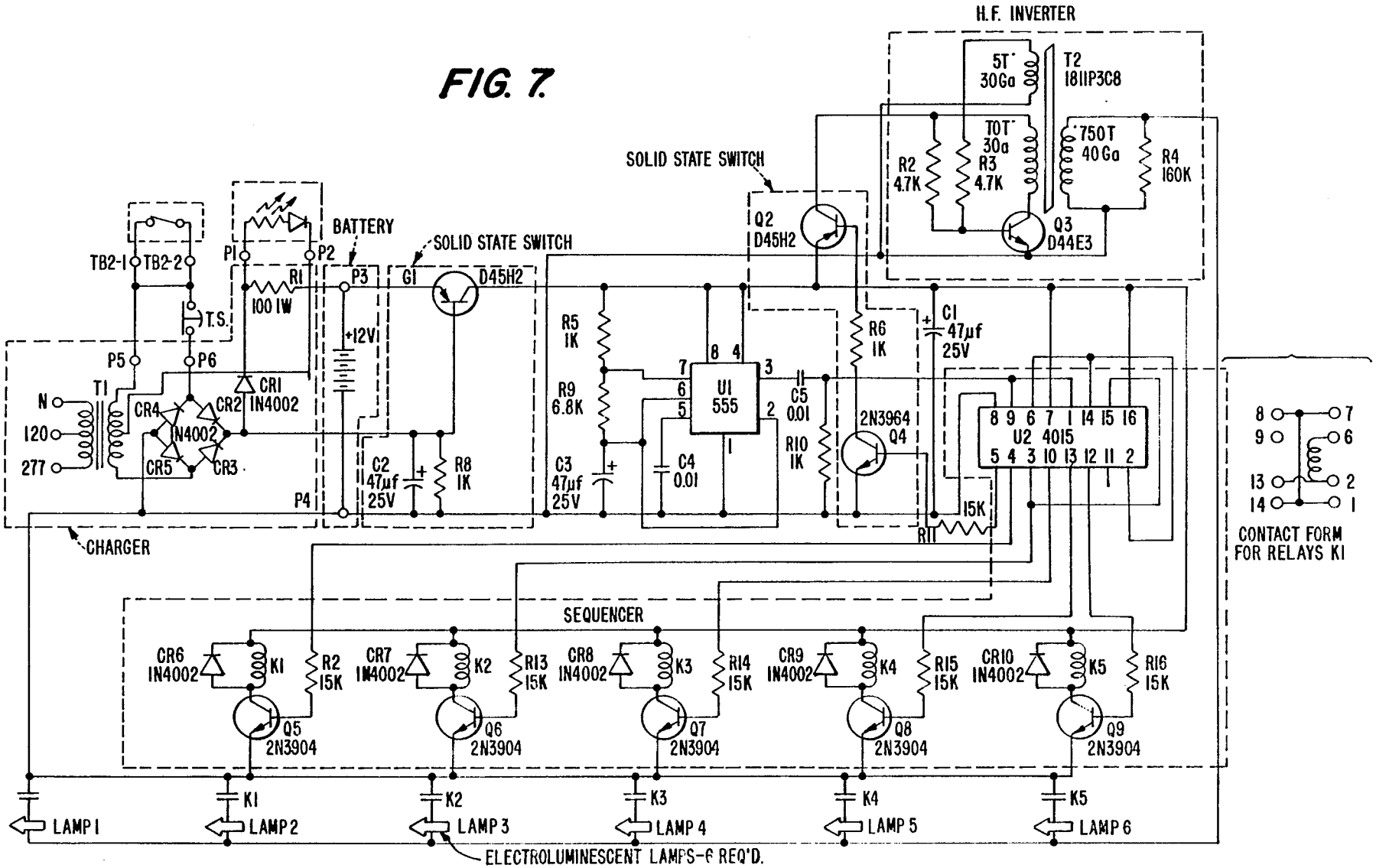
FIG. 7 is a schematic diagram of the electronic system shown in FIG. 6.

As shown in FIG. 2, the illuminating means includes a control unit 20 having a housing 22 and an electronic system 24 shown in the block schematic diagram of FIG. 6. The electronic circuitry of the block diagram is shown in FIG. 7. The electronic circuitry 24 includes a sequencer 26 for sequentially illuminating at least three electroluminescent lamps 14 on a repeated basis in order from one end of the linear arrangement of electroluminescent lamps 14 to the other end of the linear arrangement of electroluminescent lamps 14. As each electroluminescent lamp is sequenced, it continues to be illuminated while the remaining lamps in the linear arrangement are being sequentially illuminated. The set of electroluminescent lamps then cease being illuminated and the sequence repeats.

According to the present invention, the illuminating means includes a sequencer, a high frequency inverter, a battery and a battery charger for illuminating the electroluminescent lamps with an independent power supply.

As shown in FIG. 6, charger 28 is connected to the power supply for the building 30 and a battery 32 to charge battery 32 when the egress direction indication system has not been activated. Battery 32 is connected to sequencer 26 through solid state switch 34.

According to the present invention, there is provided means for actuating the illuminating means in response to power failure and means for actuating the illuminating means in response to smoke detection.

As shown in FIG. 6, solid state switch 34 connects battery 32 to sequencer 26 when it is no longer supplied with power either because of a power failure or because the link in smoke detector 36 is broken in response to smoke detection.

In accordance with the present invention, the system includes a housing for containing the means for sequentially illuminating the electroluminescent lamps; and the panel and housing include respective complementary means for electrically connecting the electroluminescent lamps in the panel with the means for sequentially illuminating the electroluminescent lamps and for supporting the panel relative to the housing.

As shown in FIG. 2, the system includes housing 22 for containing the electronic circuitry 24 which is detailed in FIGS. 6 and 7. As shown in FIG. 2, the complementary connecting means on the panel 16 and the housing 22 includes a male electrical connector 38 and a complementary female electrical connector 40. As shown in FIG. 3, male electrical connector 38 includes contacts 42 connected to electric conductors 18*a* and 18*b*. Contacts 42 in male electric connector 38 engage contacts 44 in female electric connector 40. When male electric connector 38 is inserted into female electric connector 40, the left end of panel 16 is supported relative to housing 22. It is also possible to use flexible electrical conduit and electrical connectors to removably connect the electronics of panel 16 and housing 22.

According to the present invention, the connecting means is located in the panel at one of said ends of the linear arrangement. As shown in FIG. 2, the connecting means is male connector 38, located at the left end of the linear arrangement.

According to the present invention, the panel at the other of said ends of the linear arrangement includes means for fastening the panel to a wall.

As shown in FIG. 2, the fastening means includes a supporting plate 46 which removably encases the right end of panel 16 and which is secured to a wall with fasteners such as screws 48. In this manner, the indicator unit 12 including panel 16 is produced as a throw-away item which can be easily installed between housing 22 and plate 46 and replaced by removing screws 48 and plate 46, disconnecting the electrical connectors 38 and 40 and inserting a replacement panel.

According to the present invention, the panel has adhesive means on the rear surface for securing the panel to a supporting surface. As shown in FIG. 4, panel 16 includes adhesive means such as double-sided tape 17 for securing panel 16 to a wall.

According to the present invention, there is provided an egress direction indication system comprising a plurality of indicator units, each indicator unit including at least three electroluminescent lamps in a linear arrangement; and means for sequentially illuminating said at least three electroluminescent lamps on a repeated basis in order from one end of the linear arrangement to the other end of the linear arrangement; each indicator unit is mounted on a wall and spaced from adjacent indicator units; a first indicator unit is positioned near a point of egress and oriented so that the linear arrangement of its lamps are sequentially illuminated in the direction of the point of egress; and at least one other indicator unit is oriented so that the linear arrangement of its lamps are sequentially illuminated in the direction of the first indicator unit.

Figure 5:
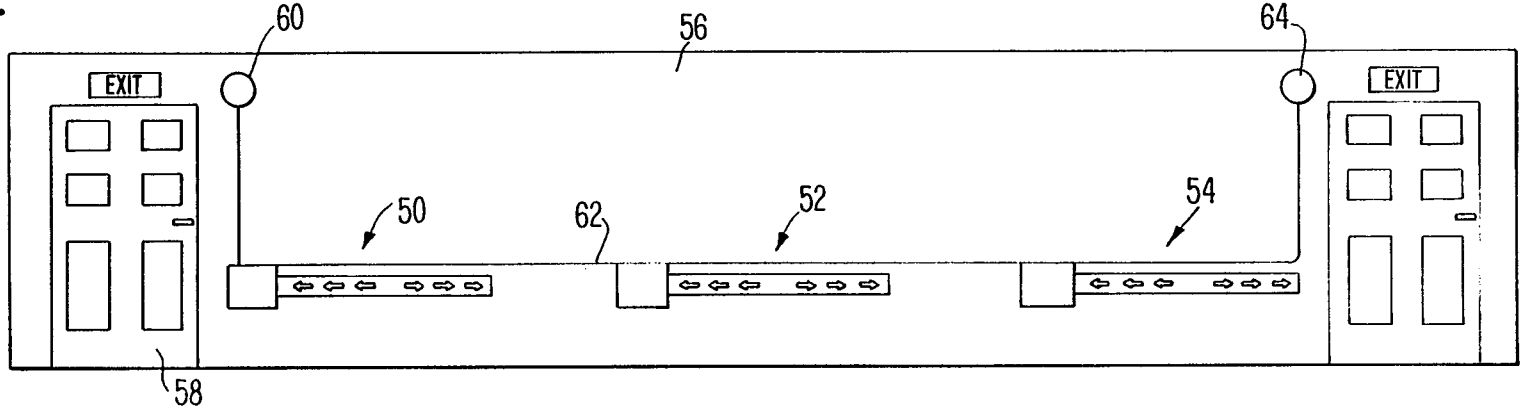
FIG. 5 is a side elevation view showing the positioning of a number of the units shown in FIG. 2 on a wall inside a building.

As shown in FIG. 5, there are three indicator units 50, 52, and 54 of the variety illustrated in FIG. 2 and previously discussed. Each indicator unit is mounted on a wall 56 and spaced from adjacent indicator units. As shown in FIG. 5, a first indicator unit 50 is positioned near a point of egress such as door 58 and oriented so that the linear arrangement of its lamps are sequentially illuminated in the direction of the door. The left three electroluminescent arrows in indicator unit 50 are sequentially illuminated in the direction of door 58 as described above.

Also as shown in FIG. 5, at least one other indicator unit, such as indicator unit 52, is oriented so that the linear arrangement of its left three electroluminescent lamps are sequentially illuminated in the direction of the first indicator unit 50. A third indicator unit 54 is oriented so that its left three lamps are sequentially illuminated in the direction of indicator unit 52 so that persons would be able to follow from indicator unit 54 to indicator unit 52 and finally to indicator 50 and exit through door 58.

In accordance with the present invention, the electroluminescent lamps of each indicator unit are positioned near each other and constitute a group in which the direction of their sequential pattern is readily observable even though the sequencing pattern of adjacent indicator units readily may not be perceived.

According to the present invention, the indicator units include a master indicator unit and at least one slave indicator unit, each slave unit electrically connected to the master unit, each master and slave unit having its own battery power supply so that each unit is failsafe and that the failure of one unit will not prevent other units from operating. The master indicator unit includes means for actuating illuminating means in the master indicator unit and at least one slave indicator unit.

As shown in FIG. 5, unit 50 is connected to smoke alarm 60 and is connected to slave units 52 and 54 through cable 62. As can be seen from the circuitry shown in FIG. 6, actuation of smoke alarm 60 or interruption of power supplied to the control units 52 or 54 through cable 62 would cause slave units 52 and 54 to actuate regardless of whether the other units actuate or fail to actuate.

In accordance with the present invention, the master indicator unit includes means for testing the system. As shown in FIG. 6, key operated switch 62 can be opened to test the system by actuation through disruption of power supply to the system.

According to the present invention, there is provided an egress direction indication system comprising an indicator unit including at least three electroluminescent lamps in a linear arrangement; means for sequentially illuminating at least three of said electroluminescent lamps on a repeated basis in order from a first end of the linear arrangement to a second end of the linear arrangement in response to a first sensed condition of relative danger at the first end; and for sequentially illuminating at least three of said electroluminescent lamps on a repeated basis in order from the second end to the first end in response to a second sensed condition of relative danger at the second end, thereby directing egress away from the area of relative danger.

As shown in FIG. 5, indicator unit 50 is connected to smoke detector 60. The three electroluminescent lamps on the right side of indicator unit 50 will sequence from the left end to the right end in response to a first sensed condition of relative danger at the first end such as smoke being sensed by smoke detector 60 at the left end of indicator unit 50.

Similarly, smoke detector 64 provides a second sensed condition of relative danger at the second end or right portion of indicator unit 50 and thereby sequentially illuminates the three electroluminescent lamps at the left side of indicator unit 50 in sequence from the right end to the left end of the indicator unit in response to the sensed condition of relative danger at the right end of indicator unit 50.

According to the present invention, the electroluminescent lamps are shaped as arrows and at least three arrows point from the first end to the second end for illumination during the first sensed condition and at least three arrows point from the second end to the first end for illumination during the second sensed condition.

As shown in FIG. 5, the three arrows on the right side of indicator units 50, 52 and 54 point from the left end to the right end for illumination during the sensed condition when smoke alarm 60 is activated. Similarly, the three arrows on the left side of indicator units 50, 52 and 54 point from the right end to the left end for illumination during the second sensed condition when smoke alarm 64 is actuated.

According to the present invention, the indicator units are placed on a wall about one and one half feet from the floor to be located at eye level for persons crawling to egress in smoke filled conditions. As shown in FIG. 5, indicator units 50, 52 and 54 are positioned on a wall about one and one half feet from the floor.

Other arrangements of electroluminescent lamps are within the scope of the invention. The indicator unit may include two headed arrow arrangements which are selectively controlled. The indicator unit may also include arrows pointing alternatively in opposing directions.

Additional advantages and modifications will readily occur to those skilled in the art. The invention in its broader aspects is, therefore, not limited to the specific details, representative apparatus, and illustrative examples shown and described. Accordingly, departures may be made from such details without departing from the scope of the general inventive concept as defined by the appended claims and their equivalents.

What is claimed is:

1. An egress direction indication system comprising:

an indicator unit including at least three electroluminescent lamps in a linear arrangement; a first means when activated for sequentially illuminating at spaced intervals to indicate a specific direction said at least three electroluminescent lamps in order from a first end of the linear arrangement to a second end of the linear arrangement; a second means responsive to the illumination of the electroluminescent lamp nearest said second end for extinguishing all said electroluminescent lamps in the linear arrangement simultaneously; and a third means responsive to the extinguishment of all the electroluminescent lamps in the linear arrangement for activating said first means.

2. The system of claim 1 wherein the electroluminescent lamps are shaped as arrows and point from said one end of the linear arrangement to said other end of the linear arrangement.

3. The system of claim 1 wherein the electroluminescent lamps are six in number.

4. The system of claim 1 wherein the illuminating means includes means for actuating the electroluminescent lamps in response to power failure.

5. The system of claim 1 wherein the illuminating means includes means for actuating the electroluminescent lamps in response to smoke detection.

6. The system of claim 1 wherein the indicator unit includes a sequencer, a high frequency inverter, a battery and a battery charger for illuminating the electroluminescent lamps with an independent power supply.

7. An egress direction indication system comprising:

a plurality of indicator units, each indicator unit including at least three electroluminescent lamps in a linear arrangement;

a first means when activated for sequentially illuminating at spaced intervals to indicate a specific direction said at least three electroluminescent lamps in order from a first end of the linear arrangement to a second end of the linear arrangement; a second means responsive to the illumination of the electroluminescent lamp nearest said second end for extinguishing all said electroluminescent lamps in the linear arrangement simultaneously; a third means responsive to the extinguishment of all the electroluminescent lamps in the linear arrangement for activating said first means; and each indicator unit being mounted on a wall and spaced from adjacent indicator units; a first indicator unit being positioned near a point of egress and oriented so that the linear arrangement of its lamps are sequentially illuminated in the direction of the point of egress; and at least one other indicator unit being oriented so that the linear arrangement of its lamps are sequentially illuminated in the direction of the first indicator unit.

8. The system of claim 7 wherein the electroluminescent lamps of each indicator unit are positioned near each other and constitute a group in which the direction of their sequential pattern is readily observable.

9. The system of claim 7 wherein the indicator units include a master indicator unit and at least one slave indicator unit, each slave unit being electrically connected to the master unit, each master and slave unit having its own battery power supply so that each unit is failsafe and that the failure of one unit will not prevent the other units from operating.

10. The system of claim 7 wherein the indicator units are positioned on a wall about one and one half feet from the floor to be located at eye level for persons crawling to egress in smoke filled conditions.

11. An egress direction indication system comprising:

an indicator unit including at least three electroluminescent lamps in the linear arrangement;

a first means when activated for sequentially illuminating at spaced intervals to indicate a specific direction at least three of said electroluminescent lamps in order from a first end of the linear arrangement to a second end of the linear arrangement in response to a first sensed condition of relative danger at the first end; a second means when activated for sequentially illuminating at spaced intervals to indicate a specific direction at least three of said electroluminescent lamps in order from the second end to the first end in response to a second sensed condition of relative danger at the second end; a third means responsive to the illumination of the at least three of said electroluminescent lamps in the linear arrangement for extinguishing all the electroluminescent lamps in the linear arrangement simultaneously; and a fourth means responsive to the extinguishment of all the electroluminescent lamps in the linear arrangement for activating one of said first and said second means in accordance with a respective first and second sensed condition, thereby directing egress away from the area of relative danger.

12. The system of claim 11 wherein the electroluminescent lamps are shaped as arrows and at least three arrows point from the first end to the second end for illumination during the first sensed condition and at least three arrows point from the second end to the first end for illumination during the second sensed condition.

13. An egress direction indication system, comprising:

an indicator unit including a plastic extruded panel having at least three electroluminescent lamps in a linear arrangement contained within the plastic extrusion; and means for sequentially illuminating said at least three electroluminescent lamps on a repeated basis in order from one end of the linear arrangement to the other end of the linear arrangement for indicating a direction of egress.

14. The system of claim 13, including a housing for containing the means for sequentially illuminating the electroluminescent lamps.

15. The system of claim 14 wherein the panel and the housing include respective complementary means for electrically connecting the electoluminescent lamps in the panel with the means for sequentially illuminating the electroluminescent lamps.

16. The system of claim 15 wherein the connecting means include means for supporting the panel relative to the housing.

17. The system of claim 16 wherein the connecting means is located in the panel at one of said ends of the linear arrangement.

18. The system of claim 17 wherein the panel at the other of said ends of the linear arrangement includes means for fastening the panel to a wall.

19. The system as recited in claim 13, wherein each of the electroluminescent lamps in the indicator unit remains illuminated until all lamps in the indicator unit have been illuminated.

20. The system of claim 13 wherein the panel has planar front and rear surfaces including adhesive means on the rear surface for securing the panel to a supporting surface.

21. The system of claim 13 wherein the panel includes a fluorescent material for emitting light.

22. An egress direction indication system, comprising:

an indicator unit including a plastic extruded panel containing a circuit board and at least three electroluminescent lamps mounted on said circuit board in a linear arrangement;

means for sequentially illuminating said at least three electroluminescent lamps on a repeated basis in order from one end of the linear arrangement to the other end of the linear arrangement; and a lens covering said electroluminescent lamps, said lens being bonded to said panel.

23. An egress direction indication system, comprising:

a plurality of indicator units including a master indicator unit and at least one slave indicator unit, each slave unit being electrically connected to the master unit, each master unit and slave unit having its own battery power supply so that each unit is fail-safe and the failure of one unit will not prevent the other units from operating, each indicator unit including at least three electroluminescent lamps in a linear arrangement;

means for sequentially illuminating said at least three electroluminescent lamps on a repeated basis in order from one end of the linear arrangement to the other end of the linear arrangement; each indicator unit being mounted on a wall and spaced from adjacent indicator units; a first indicator unit positioned near a point of egress and oriented so that the linear arrangement of its lamps are sequentially illuminated in the direction of the point of egress, and at least one other indicator unit being oriented so that the linear arrangement of its lamps are sequentially illuminated in the direction of the first indicator unit; and means in said master indicator unit for actuating the illuminating means in the master indicator unit and said at least one slave indicator unit.

24. The system of claim 23, wherein the master indicator unit includes means for testing the system.

* * * * *